US008097055B2

(12) United States Patent
Staley et al.

(10) Patent No.: US 8,097,055 B2
(45) **Date of Patent: *Jan. 17, 2012**

(54) SYSTEM FOR TREATING EXHAUST GAS

(75) Inventors: Thomas V. Staley, Peoria, IL (US); Loran J. Hoffman, Washington, IL (US); Ryan M. Duffek, Dunlap, IL (US); Richard A. Crandell, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 1104 days.

This patent is subject to a terminal disclaimer.

(21) Appl. No.: 11/978,415

(22) Filed: Oct. 29, 2007

(65) Prior Publication Data

US 2009/0107115 A1 Apr. 30, 2009

(51) Int. Cl.
*B01D 50/00* (2006.01)
*B01D 53/34* (2006.01)
*F02M 35/024* (2006.01)

(52) U.S. Cl. ..... 55/385.3; 55/498; 55/DIG. 28; 55/DIG. 30; 123/184.57; 123/198 E; 181/228; 181/229; 422/168; 422/169; 422/177; 422/179; 422/180; 60/297; 60/299; 60/311; 285/407; 285/420

(58) Field of Classification Search ..... 55/385.3, 55/498, DIG. 28, DIG. 30; 123/198 E, 184.57; 181/228, 229; 422/168, 169, 177, 179, 180; 60/297, 299, 311; 285/407, 420
See application file for complete search history.

(56) References Cited

U.S. PATENT DOCUMENTS 3,420,052 A 1/1969 Miller
3,607,133 A 9/1971 Hirao
(Continued)

FOREIGN PATENT DOCUMENTS

EP 1 965 046 A1 9/2008
(Continued)

OTHER PUBLICATIONS

C. Wassermayr, W. Brandstaner and P. Prenninger, Theisel 2002 Conference on Thermo- and Fluid-Dynamic Processes in Diesel Engines, "An Integratead Approach for the Design of Diesel Engine Exhaust Systems to meeting Euro 4 and beyond Emissions Legislations," pp. 1-15.

(Continued)

*Primary Examiner* — Duane Smith
*Assistant Examiner* — Minh-Chau Pham
(74) *Attorney, Agent, or Firm* — D. James Barnes; Finnegan, Henderson, Farabow, Garrett & Dunner LLP

(57) ABSTRACT

A system for treating exhaust gas from an engine is disclosed. The system may include a housing with a first longitudinal axis, an inlet port, and an outlet port. The housing may define a first flow path. A fluid treatment element may be arranged in the flow path. The system may also include a conduit defining a second longitudinal axis and forming a second flow path. The conduit may have first and second tubular portions generally aligned with the second longitudinal axis. The first tubular portion may have a first cross-section, and the second tubular portion may have a second cross-section. An inner diameter of the second cross-section may be less than an inner diameter of the first cross-section. The centerpoint of the first inner diameter may be offset from the centerpoint of the second inner diameter in a direction generally parallel to the first longitudinal axis.

20 Claims, 7 Drawing Sheets

U.S. PATENT DOCUMENTS

| | | | | |
|---|---|---|---|---|
| 3,852,042 | A | 12/1974 | Wagner | |
| 3,892,536 | A | 7/1975 | Roeser et al. | |
| 5,043,146 | A * | 8/1991 | Ishikawa et al. | 422/176 |
| 5,921,214 | A * | 7/1999 | Fujita et al. | 123/198 E |
| 6,712,869 | B2 | 3/2004 | Cheng et al. | |
| 6,767,378 | B2 | 7/2004 | Nishiyama et al. | |
| 6,824,743 | B1 | 11/2004 | Pawson et al. | |
| 6,883,311 | B2 | 4/2005 | Liu | |
| 6,887,294 | B2 | 5/2005 | Kanematsu | |
| 7,062,904 | B1 | 6/2006 | Hu et al. | |
| 7,150,260 | B2 * | 12/2006 | Arevalo et al. | 123/198 E |
| 7,299,626 | B2 | 11/2007 | Barasa et al. | |
| 7,501,005 | B2 * | 3/2009 | Thaler | 55/523 |
| 2005/0178111 | A1 | 8/2005 | Kammel | |
| 2006/0277900 | A1 | 12/2006 | Hovda et al. | |
| 2007/0039316 | A1 | 2/2007 | Bosanec, Jr. et al. | |
| 2007/0137187 | A1 | 6/2007 | Kumar | |
| 2007/0175187 | A1 * | 8/2007 | Kopec et al. | 55/385.3 |
| 2008/0072580 | A1 | 3/2008 | Nagaoka et al. | |
| 2008/0138256 | A1 * | 6/2008 | Salasc et al. | 422/168 |
| 2008/0155973 | A1 | 7/2008 | Maruyama et al. | |
| 2008/0178585 | A1 | 7/2008 | Bruza | |
| 2009/0084344 | A1 * | 4/2009 | Fasan | 123/198 E |

FOREIGN PATENT DOCUMENTS

| | | | |
|---|---|---|---|
| EP | 1596044 | | 2/2009 |
| FR | 2 843 776 | A1 | 2/2004 |
| JP | 58 076122 | A | 5/1983 |
| WO | WO 00/39437 | | 7/2000 |
| WO | WO 01/83957 | A1 | 11/2001 |
| WO | 2006027460 | | 3/2006 |
| WO | 2007078411 | | 7/2007 |
| WO | 2008025920 | | 3/2008 |

OTHER PUBLICATIONS

#2573, Photo of exhaust treatment arrangement displayed by a non-Caterpillar company at the Mid-America Trucking Show on Mar. 22, 2007 in Louisville, Kentucky.

#2548, Photo of exhaust treatment arrangement displayed by a non-Caterpillar company at the Mid-America Trucking Show on Mar. 22, 2007 in Louisville, Kentucky.

English-language Abstract of FR 2 843 776 A1, Feb. 2004.

English-language Abstract of JP 58 076122 A, May 1983.

International Search Report and Written Opinion issued Sep. 28, 2009, for Int'l Application No. PCT/US2009/036202, filed Mar. 5, 2009.

* cited by examiner

SYSTEM FOR TREATING EXHAUST GAS

TECHNICAL FIELD

This disclosure relates generally to a system for treating gas and, more particularly, to a system for effectively and efficiently treating exhaust gas from an engine.

BACKGROUND

Exhaust treatment systems for treating exhaust gas from an engine are typically mounted downstream from an engine and may include a diesel particulate filter or some other exhaust treatment element arranged within the flow path of exhaust gas. The exhaust gas is typically forced through the exhaust treatment element to positively impact the exhaust gas, for example by reducing the amount of particulate matter or NOx introduced into atmosphere as a result of engine operation.

Exhaust treatment systems may be designed for (i) maximum positive effect on engine exhaust gas and (ii) minimal negative impact on engine performance. For example, exhaust treatment systems may be designed with diffuser elements and/or various complex geometries intended to better distribute exhaust flow across the face of an exhaust treatment element while minimally impacting exhaust flow resistance.

U.S. Pat. No. 6,712,869 to Cheng et al. discloses an exhaust aftertreatment device with a flow diffuser positioned downstream of an engine and upstream of an aftertreatment element. The diffuser of the '869 patent is intended to de-focus centralized velocity force flow against the aftertreatment element and even out an exhaust flow profile across the aftertreatment element. The disclosed design of the '869 patent is intended to enable a space-efficient and flow-efficient aftertreatment construction.

It may be desirable to use an improved exhaust treatment system that effectively impacts exhaust gas while minimally impacting engine performance. Moreover, it may be desirable to use an improved exhaust treatment system that accomplishes desired performance characteristics in a cost-effective and practically manufacturable manner.

The present disclosure is directed, at least in part, to various embodiments that may achieve desirable impact on aftertreatment effectiveness while improving one or more aspects of prior systems.

SUMMARY

In one aspect, a system for treating exhaust gas from an engine is disclosed. The system may include a housing with a first longitudinal axis, an inlet port, and an outlet port. The housing may define a first generally longitudinal flow path arranged generally along or generally parallel with the first longitudinal axis of the housing and between the inlet port and the outlet port. A fluid treatment element may be arranged in the first generally longitudinal flow path of the housing. The system may also include a conduit defining a second longitudinal axis and forming a second flow path generally along the second longitudinal axis. The second longitudinal axis may be generally transverse to the first longitudinal flow path. The conduit may be configured to communicate exhaust gas with a first port of the housing and may have first and second tubular portions generally aligned with the second longitudinal axis of the conduit. The first tubular portion may have a first cross-section defined in part by a first inner diameter measured in a direction generally parallel with the first longitudinal axis of the housing, and the second tubular portion may have a second cross-section arranged proximate the first port of the housing and defined in part by a second inner diameter measured in a direction generally parallel with the first longitudinal axis of the housing. The second inner diameter of the second cross-section may be less than the first inner diameter of the first cross-section. The centerpoint of the first inner diameter of the first cross-section may be offset from the centerpoint of the second inner diameter of the second cross-section by an offset amount measured in a direction generally parallel to the first longitudinal axis of the housing.

In another aspect, a system for treating exhaust gas from an engine is disclosed. The system may include a housing with a first longitudinal axis, an inlet port, and an outlet port. The housing may define a first generally longitudinal flow path arranged generally along or parallel with the first longitudinal axis of the housing and between the inlet port and the outlet port. A fluid treatment element may be arranged in the first generally longitudinal flow path of the housing. The system may also include an inlet conduit defining a second longitudinal axis and forming a second flow path generally along the second longitudinal axis. The second longitudinal axis may be generally transverse to the first longitudinal flow path. The inlet conduit may be configured to communicate exhaust gas toward the inlet port of the housing and may have first and second tubular portions generally along the second longitudinal axis of the inlet conduit. The first tubular portion may have a first cross-section defined in part by a first inner diameter measured in a direction generally parallel with the first longitudinal axis of the housing, and the second tubular portion may have a second cross-section arranged proximate the inlet port of the housing and defined in part by a second inner diameter measured in a direction generally parallel with the first longitudinal axis of the housing. A centerpoint of the first inner diameter of the first cross-section may be offset from the centerpoint of the second inner diameter of the second cross-section by a first offset amount measured in a direction generally parallel to the first longitudinal axis of the housing. The system may further include an outlet conduit defining a third longitudinal axis and forming a third flow path generally along the third longitudinal axis. The third longitudinal axis may be generally transverse to the first longitudinal flow path. The outlet conduit may be configured to communicate exhaust gas away from the outlet port of the housing and may have third and fourth tubular portions generally along the third longitudinal axis of the outlet conduit. The third tubular portion may have a third cross-section defined in part by a third inner diameter measured in a direction generally parallel with the first longitudinal axis of the housing, and the fourth tubular portion may have a fourth cross-section arranged proximate the outlet port of the housing and defined in part by a fourth inner diameter measured in a direction generally parallel with the first longitudinal axis of the housing. The centerpoint of the third inner diameter of the third cross-section may be offset from the centerpoint of the fourth inner diameter of the fourth cross-section by a second offset amount measured in a direction generally parallel to the first longitudinal axis of the housing.

It is to be understood that both the foregoing general description and the following detailed description are exemplary and explanatory only and are not restrictive of inventive scope, as claimed.

BRIEF DESCRIPTION OF THE DRAWINGS

The accompanying drawings, which are incorporated in and constitute a part of this specification, illustrate exemplary embodiments or features of the disclosure and, together with the description, help explain principles of the disclosure. In the drawings.

Although the drawings depict exemplary embodiments or features of the present disclosure, the drawings are not necessarily to scale, and certain features may be exaggerated in order to provide better illustration or explanation. The exemplifications set out herein illustrate exemplary embodiments or features, and such exemplifications are not to be construed as limiting the inventive scope in any manner.

DETAILED DESCRIPTION

Reference will now be made in detail to specific embodiments or features, examples of which are illustrated in the accompanying drawings. Generally, the same or corresponding reference numbers will be used throughout the drawings to refer to the same or corresponding parts. It should be appreciated that the terms width and length as used herein do not necessarily mean shortest dimension or longest dimension, respectively, and are merely used in conjunction with the drawings and the explanations herein to help describe and compare various relative dimensions of an embodiment. It should also be appreciated that the term diameter used herein does not necessarily connote a circular cross-section.

Figure 1:
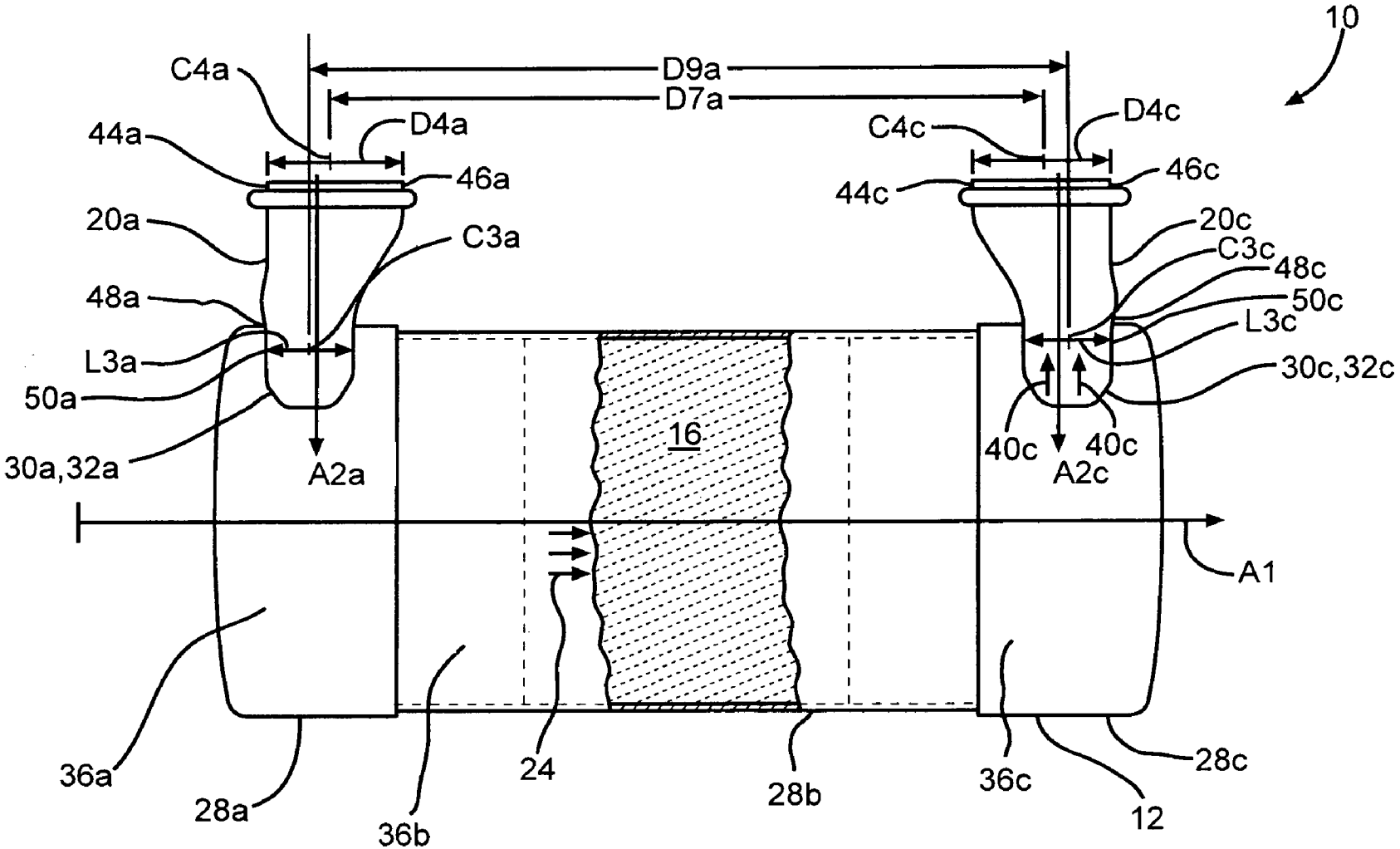
FIG. 1 is a partial diagrammatic sectioned front view of an exhaust treatment system.
Figure 2:
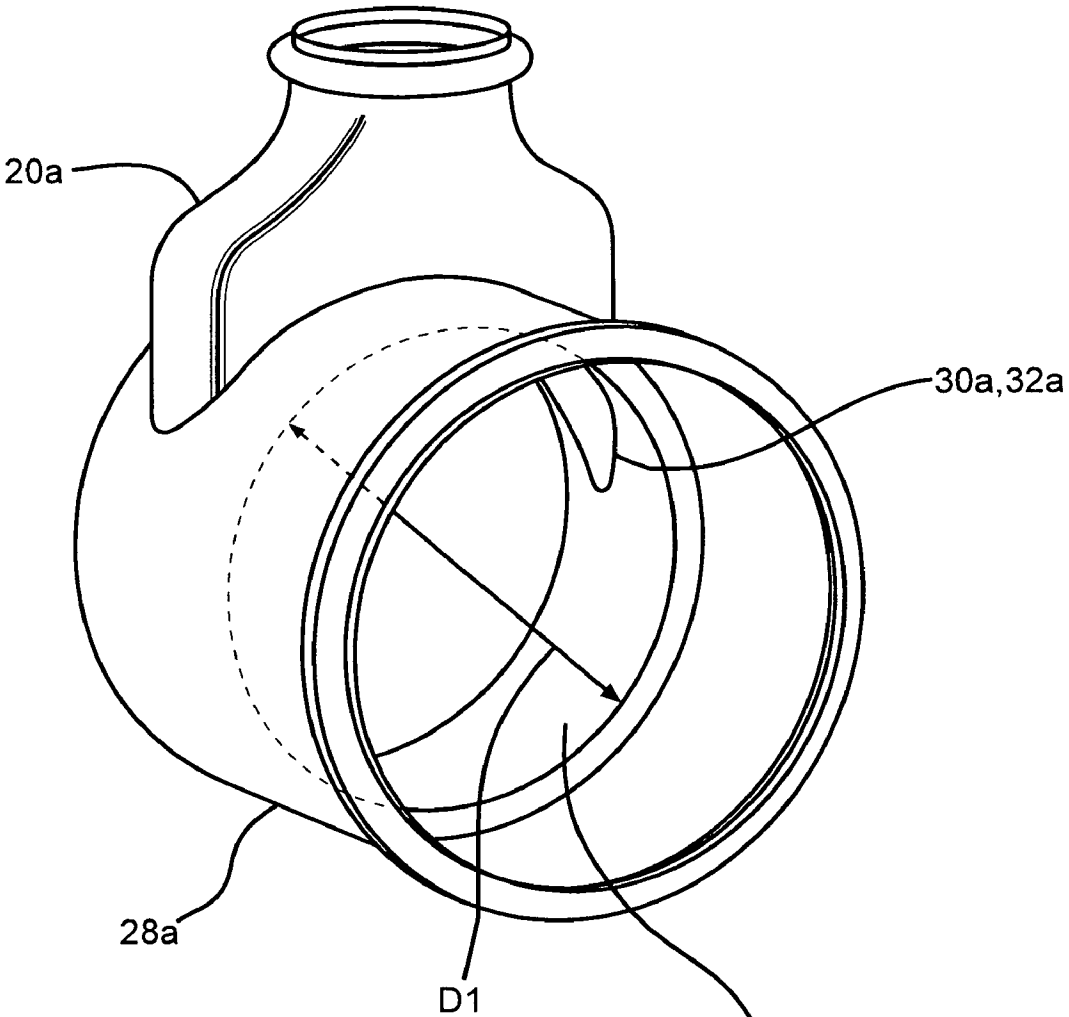
FIG. 2 is a partial diagrammatic perspective view of a portion of the exhaust treatment system of FIG. 1.

Referring now to FIG. 1, an exhaust treatment system 10 configured for treating exhaust gas from an engine is shown. The system may generally include a housing 12, a fluid treatment element 16 arranged within the housing 12, and inlet and outlet conduits 20*a*, 20*c* for communicating exhaust gas to and from the housing 12.

The housing 12 may generally define a longitudinal axis A1, along which the length of the housing 12 may generally extend. In one embodiment, the housing 12 may be formed from one or more generally cylindrical housing members 28*a*, 28*b*, 28*c* having generally tubular walls 36*a*, 36*b*, 36*c* that may cooperate to define a flow path 24 within the housing 12 extending generally along or generally parallel to the longitudinal axis A1. It should be appreciated that exhaust gas may flow in various directions at specific locations within the housing 12, and that the general resulting flow path 24 of exhaust gas through the housing 12 may be in a direction generally along or generally parallel to the longitudinal axis A1, i.e., away from the inlet conduit 20*a* and toward the outlet conduit 20*c*. The tubular walls 36*a*, 36*b*, 36*c* may each have an internal diameter D1, D2, D3 (FIG. 3) extending generally transverse to the flow path 24. The housing members 28*a*, 28*b*, 28*c* may be detachable from one another so that access to an interior portion of the housing 12 may be obtained, for example to service the system 10.

The housing 12 may have a first opening 30*a* (FIG. 3) through the generally tubular wall 36*a* to form an inlet port 32*a* and may have a second opening 30*c* through the generally tubular wall 36*c* to form an outlet port 32*c*. Thus, exhaust gas may be received into housing 12 through the inlet port 32*a* and may be discharged from housing 12 through the outlet port 32*c*. Between the inlet port 32*a* and the outlet port 32*c*, exhaust gas may flow along the generally longitudinal flow path 24 away from the inlet port 32*a* and toward the outlet port 32*c*. Since a fluid treatment element 16 may be arranged within the housing 12 and in the flow path 24, exhaust gas may be forced through the fluid treatment element 16 as it passes through the housing 12.

Figure 3:
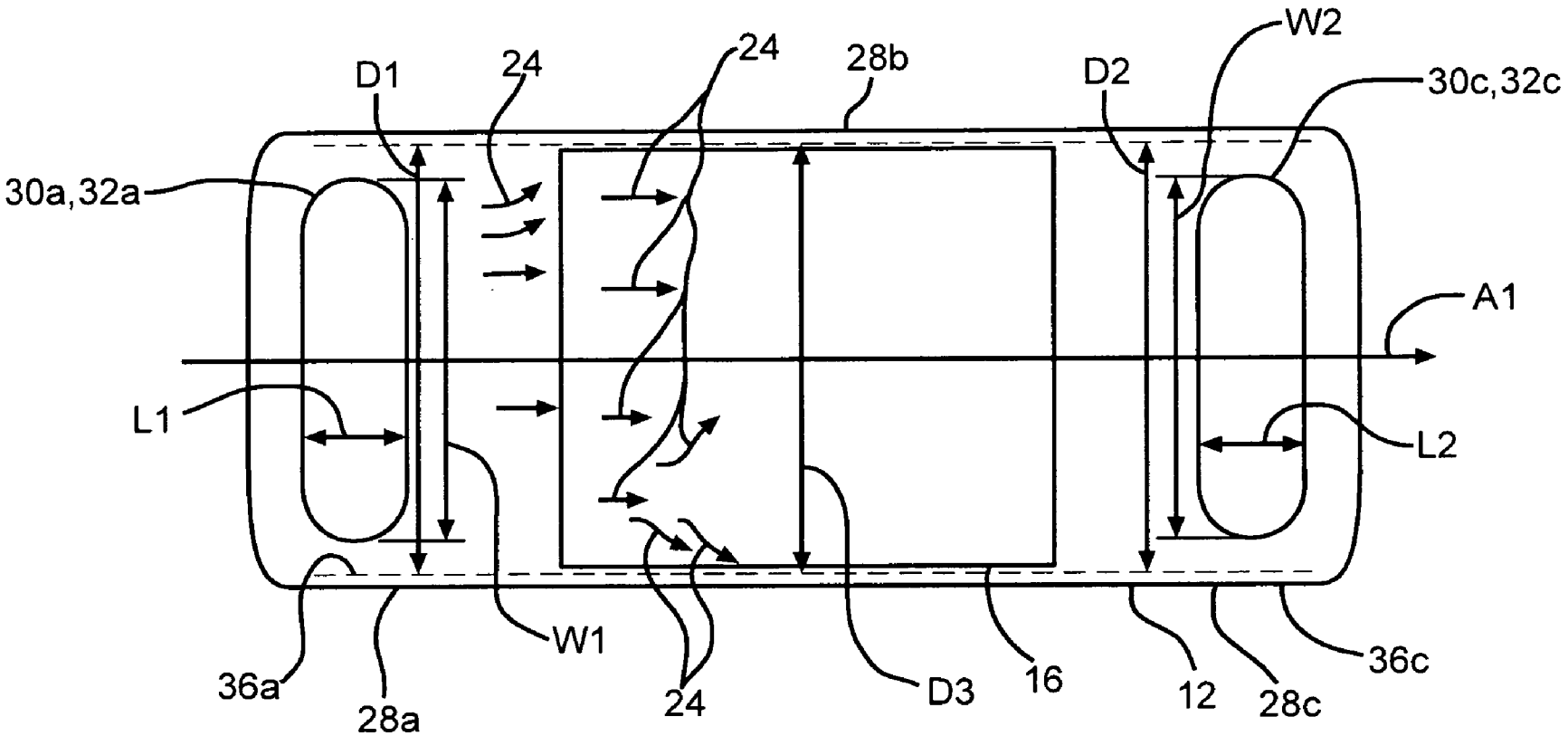
FIG. 3 is a partial top plan view of the exhaust treatment system of FIG. 1.

As best seen in FIG. 3, the first and second openings 30*a*, 30*c* forming the inlet port 32*a* and the outlet port 32*c* may be generally elongated. Each opening 30*a*, 30*c* may have a length L1, L2 (for example measured in a direction generally parallel with the longitudinal axis A1) and may have a width W1, W2 (for example measured in a direction generally parallel with an internal diameter D1 of the housing 12) greater than the respective length L1, L2. In one embodiment, the opening 30*a* may have a width W1 greater than or equal to 50 percent of the inner diameter D1 of the tubular wall 36*a* of the housing 12. For example, the width W1 may be greater than or equal to 60 percent of the inner diameter D1 of the tubular wall 36*a* of the housing 12. In another embodiment the width W1 may be greater than or equal to 70 percent of the inner diameter D1 of the tubular wall 36*a* of the housing 12. In one example, the width W1 could be approximately 175 mm, while the inner diameter D1 of the tubular wall 36*a* of the housing could be approximately 245 mm, so that the width W1 would be approximately equal to 71 percent of the inner diameter D1 of the tubular wall 36*a* of the housing. It yet another embodiment, the width W1 may be greater than or equal to 80 percent of the inner diameter D1 of the tubular wall 36*a* of the housing 12.

It should be appreciated that in some embodiments the openings 30*a*, 30*c* may have the same or substantially the same configuration. Alternatively, the openings 30*a*, 30*c* may have similar or substantially different configurations. For example, opening 30*c* may be the same width as, wider, or narrower than opening 30*a* and may be the same length as, longer, or shorter than opening 30*a*.

As referenced above, the fluid treatment element 16 may be arranged in the flow path 24 of the housing 12 and may be configured to treat exhaust gas from an engine. For example, the fluid treatment element 16 may be a filter element configured to remove particulate matter from exhaust gas. The element 16 may further or alternatively be a catalyzed substrate for catalyzing NOx. Further or alternatively, the element 16 may be any type of element for treating exhaust gas from an engine, for example by removing, storing, oxidizing, or otherwise interacting with exhaust gas to accomplish or help accomplish a desired impact on the exhaust gas or a constituent thereof.

The inlet conduit 20*a* may be configured and arranged to communicate exhaust gas with the inlet port 32*a* of the housing 12. The inlet conduit 20*a* may be rigidly fluidly connected with the inlet port 32*a*, for example via a welded connection between the conduit 20*a* and the tubular wall 36*a* around the circumference of the inlet port 32*a*. In the embodiment of FIG. 1, the inlet conduit 20*a* is connected with the tubular wall 36*a* proximate the opening 30*a* and is configured and arranged generally transverse to the longitudinal axis A1 of the tubular wall 36*a* so that a flow path 40*a* of exhaust gas through the inlet port 32*a* is generally transverse to the longitudinal axis A1 of the housing 12 and the tubular wall 36*a*.

The inlet conduit 20*a* may generally define a longitudinal axis A2*a* and may form a flow path 40*a* arranged generally along the longitudinal axis A2*a*. The longitudinal axis A2*a* may extend in a direction generally transverse to the first longitudinal flow path 24, for example so that exhaust gas transmitted through the inlet conduit 20*a* into the housing 12 substantially changes direction to flow generally along the flow path 24.

Figure 5:
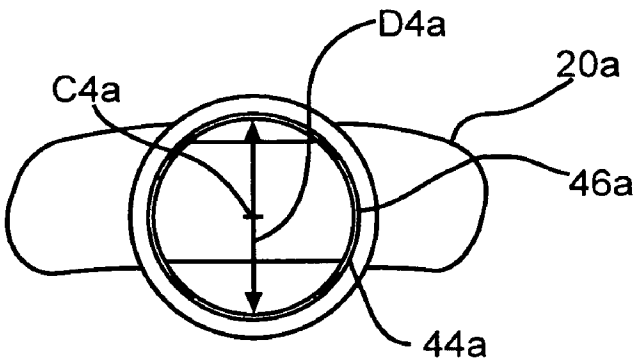
FIG. 5 is a partial top view of the conduit of FIG. 4.

The inlet conduit 20*a* may include first and second tubular portions 44*a*, 48*a* arranged generally along the longitudinal axis A2*a* of the inlet conduit 20*a*. The first tubular portion 44*a* may have a generally circular cross-section 46*a* with an inner diameter D4*a* (FIG. 5) (for example measured in a direction generally parallel with the first longitudinal axis A1 of the housing 12) and an associated cross-sectional area through which exhaust gas may flow. The inner diameter D4*a* may have a centerpoint C4*a* dividing the inner diameter D4*a* in half.

The second tubular portion 48*a* may be arranged proximate the inlet port 32*a* of the housing 12 and may have a generally elongated cross-section 50*a* proximate the inlet port 32*a*. The cross section 50*a* of the second tubular portion 48*a* may have an inner diameter or length L3*a* (FIGS. 1 and 6), for example measured in a direction generally parallel with the first longitudinal axis A1 of the housing 12. As shown in the embodiment of FIG. 1, the inner diameter L3 of the cross section 50*a* of the second tubular portion 48*a* may be shorter than the inner diameter D4*a* of the cross-section 46*a* of the first tubular portion 44*a*. The inner diameter L3 may have a centerpoint C3*a* dividing the inner diameter L3*a* in half.

Figure 6:
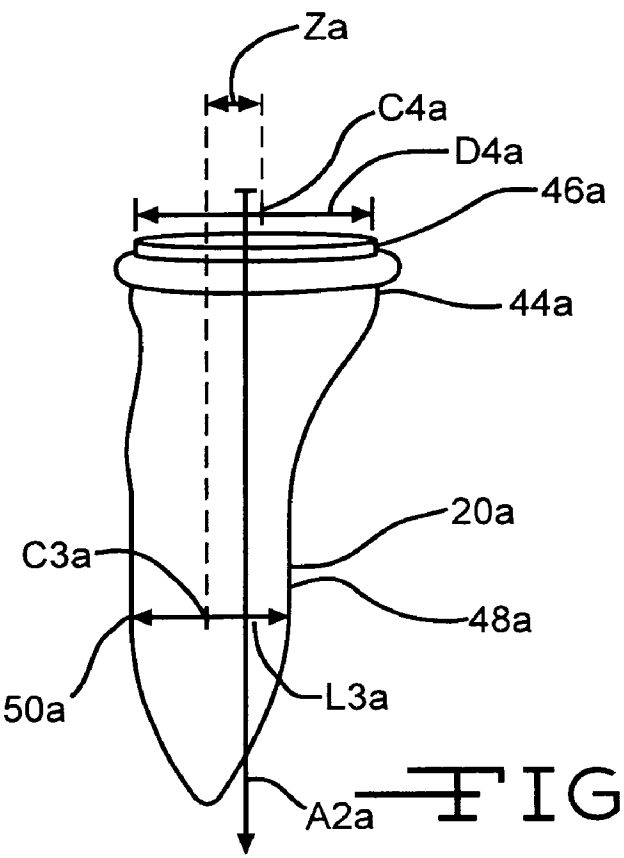
FIG. 6 is a partial side view of the conduit of FIG. 4.

As shown in FIG. 6, the centerpoint C4*a* of the inner diameter D4*a* of the cross-section 46*a* may be offset from the centerpoint C3*a* of the inner diameter L3*a* of the cross-section 50*a* by an offset amount Za (for example measured in a direction generally parallel to the first longitudinal axis A1 of the housing 12). In one embodiment, the offset amount Za may be equal to or greater than 5 percent of the inner diameter D4*a*. In another embodiment, the offset amount Za may be larger, for example equal to or greater than about 20 percent of the inner diameter D4*a*. In one example embodiment, the inner diameter D4*a* may be approximately 120 mm, the inner diameter L3*a* may be approximately 75 mm, and the offset amount may be approximately 24 mm. In this example, the offset amount Za is about 20 percent of the inner diameter D4*a*.

The cross section 50*a* of the second tubular portion 48*a* may have an internal width W3*a* (FIG. 4), for example measured in a direction generally perpendicular to the inner diameter L3. The internal width W3*a* of the cross section 50*a* may be greater than the inner diameter L3 of the cross section 50*a* such that the cross section 50*a* has an elongated configuration. The internal width W3*a* of the cross section 50*a* may also be greater than the inner diameter D4 of the cross section 46*a* of the first tubular portion 44*a*. In one embodiment, the internal width W3*a* of the cross section 50*a* may be equal to or greater than 50 percent of the inner diameter D1 of the tubular wall 36*a* of the housing 12. For example, the internal width W3*a* of the cross section 50*a* may be equal to or greater than 60 percent of the inner diameter D1 of the tubular wall 36*a* of the housing 12. In another embodiment, the internal width W3*a* of the cross section 50*a* may be equal to or greater than 70 percent of the inner diameter D1 of the tubular wall 36*a* of the housing 12. In one example, the internal width W3*a* could be approximately 175 mm, while the inner diameter D1 of the tubular wall 36*a* of the housing 12 could be approximately 245 mm, so that the internal width W3*a* of the cross section 50*a* would be approximately equal to 71 percent of the inner diameter D1 of the tubular wall 36*a* of the housing 12. In yet another embodiment, the internal width W3*a* of the cross section 50*a* may be equal to or greater than 80 percent of the inner diameter D1 of the tubular wall 36*a* of the housing 12.

The cross sectional area of the cross section 50*a* of the second tubular portion 48*a* may be greater than the cross sectional area of the cross section 46*a* of the first tubular portion 44*a*. A cross-sectional area ratio AR may be defined by the cross-sectional area of the cross section 50*a* divided by the cross-sectional area of the cross section 46*a*. In one embodiment, the cross-sectional area ratio AR may be equal to or greater than about 1.1. In another embodiment, the cross-sectional area ratio AR may be equal to or greater than about 1.2. In another embodiment, the cross-sectional area ratio AR may be equal to or greater than about 1.5. In a further embodiment, the cross-sectional area ratio AR may be in the range of about 1.6 to 1.8, for example about 1.7. Controlling the cross-sectional area ratio AR helps control backpressure on the engine as well as velocity of exhaust flowing into the housing 12. The cross-sectional area ratio AR also helps control flow distribution into the housing 12 and toward the treatment element 16.

As indicated in FIG. 1, in one embodiment the dimensions, arrangements, features, and configurations of the outlet conduit 20*c* (e.g., A2*c*, C4*c*, D4*c*, L3*c*, W3*c*, Zc, 40*c*, 44*c*, 46*c*, 48*c*, and 50*c*, etc.) may be substantially identical to those of the inlet conduit 20*a* described above. FIG. 1 shows an embodiment in which the outlet conduit 20*c* is rotated 180 degrees compared with the orientation of the inlet conduit 20*a* and attached to the outlet port 32*c* in substantially the same way as the inlet conduit 20*a* is arranged and connected with the inlet port 32*a*. Of course, alternative embodiments may be dimensioned, arranged, or configured differently.

The outlet conduit 20*c* may be configured and arranged to communicate exhaust gas with the outlet port 32*c* of the housing 12. The outlet conduit 20*c* may be rigidly fluidly connected with the outlet port 32*c*, for example via a welded connection between the conduit 20*c* and the tubular wall 36*c* around the circumference of the outlet port 32*c*. In the embodiment of FIG. 1, the outlet conduit 20*c* is connected with the tubular wall 36*c* proximate the opening 30*c* and is configured and arranged generally transverse to the longitudinal axis A1 of the tubular wall 36*c* so that a flow path 40*c* of exhaust gas through the outlet port 32*c* is generally transverse to the longitudinal axis A1 of the housing 12 and the tubular wall 36*c*.

The outlet conduit 20*c* may generally define a longitudinal axis A2*c* and may form a flow path 40*c* arranged generally along the longitudinal axis A2*c*. The longitudinal axis A2*c* may extend in a direction generally transverse to the first longitudinal flow path 24, for example so that exhaust gas transmitted from the housing 12 into the outlet conduit 20*c* substantially changes direction to flow generally along the flow path 40*c*.

The outlet conduit 20*c* may include first and second tubular portions 44*c*, 48*c* arranged generally along the longitudinal axis A2*c* of the outlet conduit 20*c*. The first tubular portion 44*c* may have a generally circular cross-section 46*c* with an inner diameter D4*c* (measured in a direction generally parallel with the first longitudinal axis A1 of the housing 12) and an associated cross-sectional area through which exhaust gas may flow. The inner diameter D4*c* may have a centerpoint C4*c* dividing the inner diameter D4*c* in half.

The second tubular portion 48*c* may be arranged proximate the outlet port 32*c* of the housing 12 and may have a generally elongated cross-section 50*c* proximate the outlet port 32*c*.

The cross section 50*c* of the second tubular portion 48*c* may have an inner diameter or length L3*c*, for example measured in a direction generally parallel with the first longitudinal axis A1 of the housing 12. As shown in the embodiment of FIG. 1, the inner diameter L3*c* of the cross section 50*c* of the second tubular portion 48*c* may be shorter than the inner diameter D4*c* of the cross-section 46*c* of the first tubular portion 44*c*. The inner diameter L3*c* may have a centerpoint C3*c* dividing the inner diameter L3*c* in half.

The centerpoint C4*c* of the inner diameter D4*c* of the cross-section 46*c* may be offset from the centerpoint C3*c* of the inner diameter L3*c* of the cross-section 50*c* by an offset amount Zc, for example measured in a direction generally parallel to the first longitudinal axis A1 of the housing 12. In one example embodiment, the inner diameter D4*c* could be approximately 120 mm, the inner diameter L3*c* could be approximately 75 mm, and the offset amount could be approximately 24 mm.

The cross section 50*c* of the second tubular portion 48*c* may have an internal width W3*c*, for example measured in a direction generally perpendicular to the inner diameter L3*c*. The internal width W3*c* of the cross section 50*c* may be greater than the inner diameter L3 of the cross section 50*c* such that the cross section 50*c* has an elongated configuration. The internal width W3*c* of the cross section 50*c* may also be greater than the inner diameter D4*c* of the cross section 46*c* of the first tubular portion 44*c*. In one embodiment, the internal width W3*c* of the cross section 50*c* may be equal to or greater than 50 percent of the inner diameter D3 of the tubular wall 36*c* of the housing 12. For example, the internal width W3*c* of the cross section 50*c* may be equal to or greater than 60 percent of the inner diameter D3 of the tubular wall 36*c* of the housing 12. In another embodiment, the internal width W3*c* of the cross section 50*c* may be equal to or greater than 70 percent of the inner diameter D3 of the tubular wall 36*c* of the housing 12. In one example, the internal width W3*c* could be approximately 175 mm, while the inner diameter D3 of the tubular wall 36*c* of the housing 12 could be approximately 245 mm, so that the internal width W3*c* of the cross section 50*c* would be approximately equal to 71 percent of the inner diameter D3 of the tubular wall 36*c* of the housing 12. In yet another embodiment, the internal width W3*c* of the cross section 50*c* may be equal to or greater than 80 percent of the inner diameter D3 of the tubular wall 36*c* of the housing 12.

The cross sectional area of the cross section 50*c* of the second tubular portion 48*c* may be greater than the cross sectional area of the cross section 46*c* of the first tubular portion 44*c*. A cross-sectional area ratio AR may be defined by the cross-sectional area of the cross section 50*c* divided by the cross-sectional area of the cross section 46*c*. In one embodiment, the cross-sectional area ratio AR may be equal to or greater than about 1.1. In another embodiment, the cross-sectional area ratio AR may be equal to or greater than about 1.2. In another embodiment, the cross-sectional area ratio AR may be equal to or greater than about 1.5. In a further embodiment, the cross-sectional area ratio AR may be in the range of about 1.6 to 1.8, for example about 1.7. Controlling the cross-sectional area ratio AR helps control backpressure on the engine. The cross-sectional area ratio AR also helps control flow distribution through the housing 12.

In one embodiment, the centerpoints C4*a*, C4*c* of the cross sections 46*a*, 46*c* may be separated by a first separation distance D7*a* measured in a direction generally parallel to the first longitudinal axis A1 of the housing 12. The centerpoints L3*a*, L3*c* of the cross sections 50*a*, 50*c* may be separated by a second separation distance D9*a* measured in a direction generally parallel to the first longitudinal axis A1 of the housing 12.

As illustrated in FIGS. 1 and 7-9, by varying configurations of the inlet and outlet conduits 20*a*, 20*c*, such as by selective orientation (e.g., rotation) of each or both conduit(s) during assembly, the distances D7, D9 may be managed as desired, for example to accommodate differing desired arrangements and differing exhaust system connection points. In FIG. 1, for example, the inlet conduit 20*a* and the outlet conduit 20*c* are arranged to minimize the separation distance D7*a*. Thus, the configuration shown in FIG. 1 may be used if the housing 12 is to be connected with an engine exhaust system with a minimal distance D7*a* between exhaust line connections (e.g., connection of engine exhaust supply to the inlet conduit 20*a*, and connection of outlet conduit 20*c* to an exhaust line for managing exhaust gas exiting the housing 12). More specifically, the embodiment of FIG. 1 shows an arrangement wherein the centerpoints C4*a*, C4*c* of the inner diameters D4*a*, D4*c* are separated by a first distance D7*a* measured in a direction generally parallel to the longitudinal axis A1 of the housing 12, and the centerpoints C3*a*, C3*c* of the inner diameters L3*a*, L3*c* are separated by a second distance D9*a* measured in a direction generally parallel to the longitudinal axis A1 of the housing 12, and the second distance D9*a* is greater than the first distance D7*a*.

Figure 9:
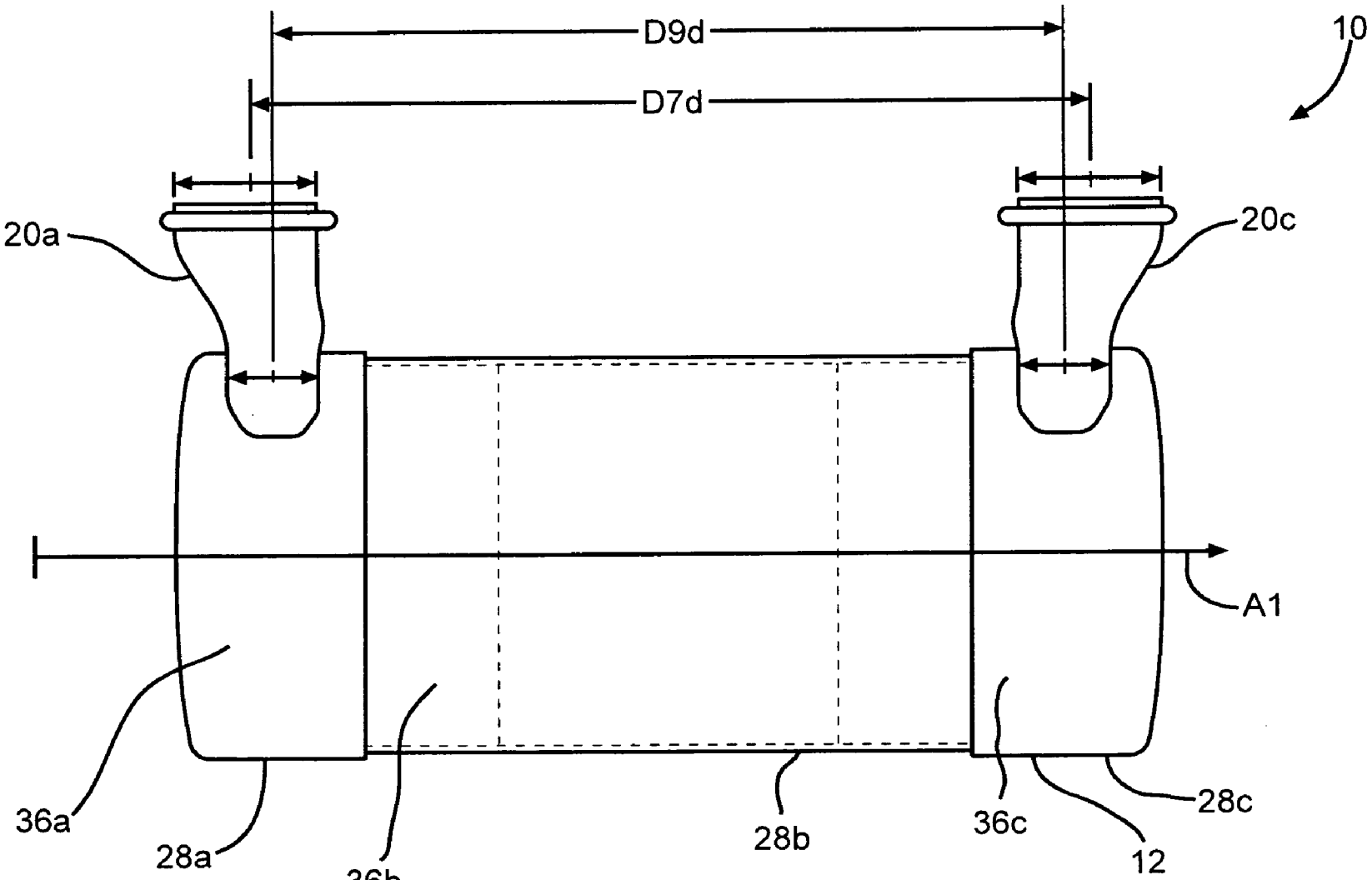
FIG. 9 is a partial diagrammatic sectioned front view of yet another alternative exhaust treatment system.

Conversely, FIG. 9 shows the inlet conduit 20*a* and the outlet conduit 20*c* both turned 180 degrees (compared to the configuration in FIG. 1) in order to maximize the separation distance D7*d* between exhaust line connections, while maintaining the same separation distance D9*a* and D9*d* in both FIGS. 1 and 9. More specifically, the embodiment of FIG. 9 shows an arrangement wherein the centerpoints C4*a*, C4*c* of the inner diameters D4*a*, D4*c* are separated by a first distance D7*d* measured in a direction generally parallel to the longitudinal axis A1 of the housing 12, and the centerpoints C3*a*, C3*c* of the inner diameters L3*a*, L3*c* are separated by a second distance D9*d* measured in a direction generally parallel to the longitudinal axis A1 of the housing 12, and the second distance D9*d* is less than the first distance D7*d*.

Figure 7:
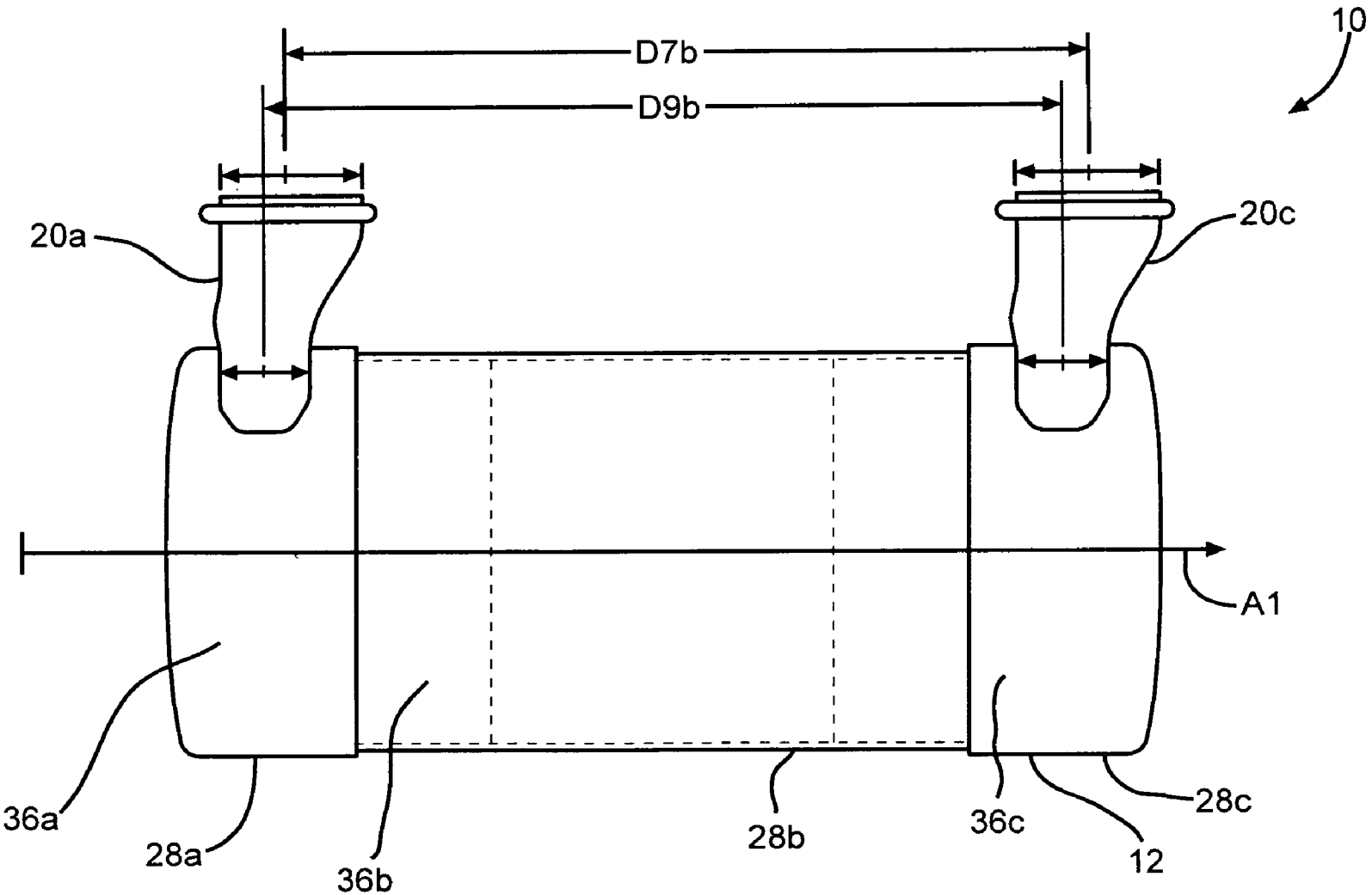
FIG. 7 is a partial diagrammatic sectioned front view of an alternative exhaust treatment system.
Figure 8:
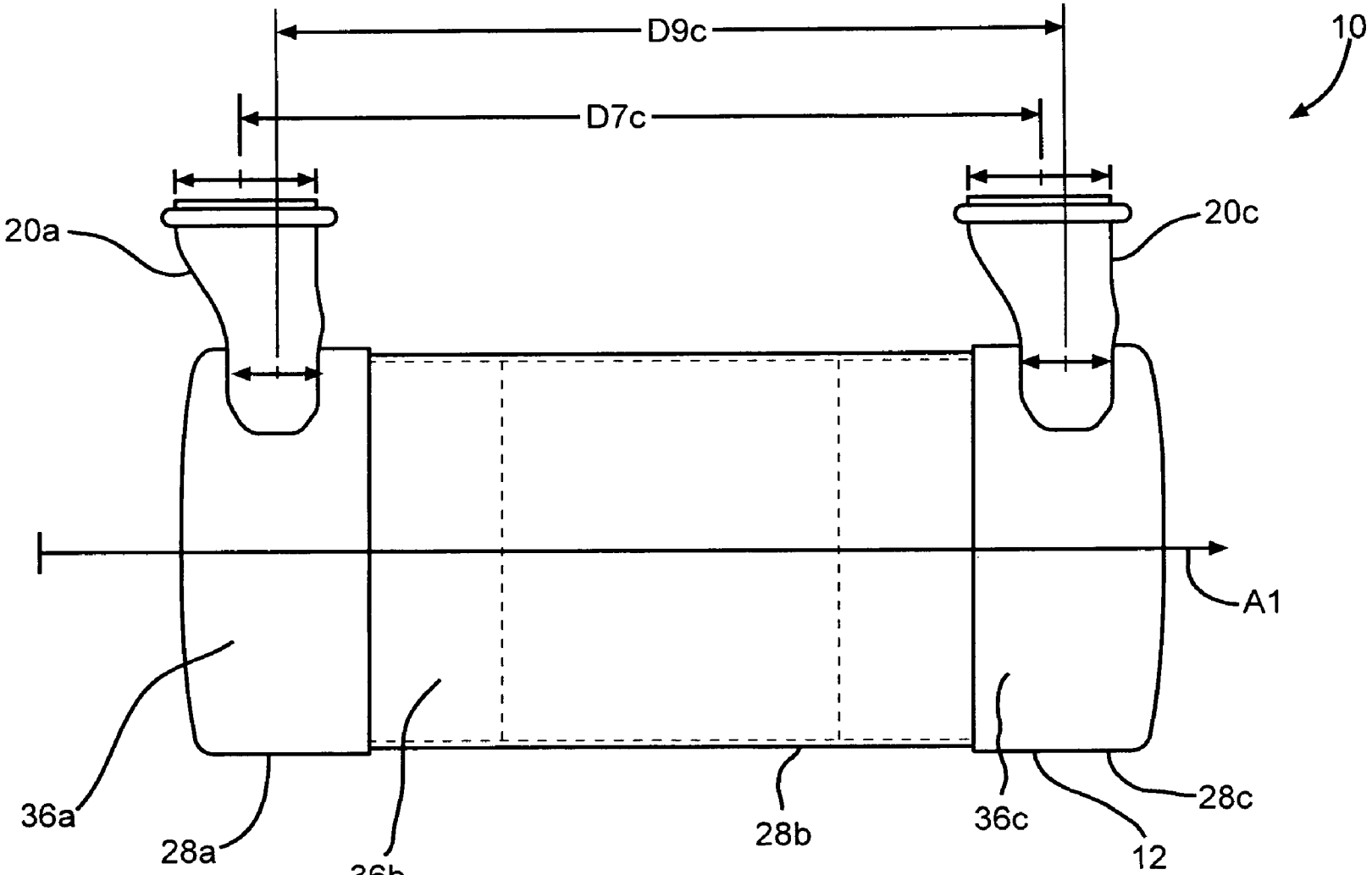
FIG. 8 is a partial diagrammatic sectioned front view of another alternative exhaust treatment system.

Moreover, FIGS. 7 and 8 show alternative arrangements having the same separation distance D7*b* and D7*c* while enabling a shift of the housing toward the rightward direction (moving from FIG. 7 to FIG. 8). In FIGS. 7 and 8, the separation distances D7*b*, D7*c* are substantially equal to the separation distances D9*b*, D9*c*, respectively.

Referring to FIG. 1, the inlet conduit 20*a* may have substantially the same inner diameter measurements D4*a*, L3*a* as the inner diameter measurements D4*c*, L3*c* of the outlet conduit 20*c*. Thus, in one embodiment, the same piece-part may be used to create the inlet conduit 20*a* and the outlet conduit 20*c*. By having the ability to vary the rotational arrangements of such piece parts 20*a*, 20*c* during assembly, differing connection requirements or housing position requirements may be accommodated by fewer housing 12 configurations, for example to accommodate different OEM truck or machine manufacturing specifications such as desired pierce-point (connection) distances between the inlet conduit 20*a* and the outlet conduit 20*c* for connecting an exhaust treatment system 10 to an engine exhaust system.

INDUSTRIAL APPLICABILITY

With at least some of the foregoing arrangements and embodiments discussed herein (e.g., FIG. 1), using an inlet conduit 20*a* that is formed to have a shorter inner diameter L3*a* (connecting into the housing 12 at the inlet port 32*a*) than the inner diameter D4*a* (connecting, in one embodiment, to an exhaust line from an engine), an axial length of the housing 12 (for example as measured along the longitudinal axis A1) may be minimized while accommodating a relatively large exhaust line (not shown), such as an exhaust line having a connection diameter the same as the inner diameter D4*a* of the inlet conduit 20*a*. Similar axial length minimization may be facilitated by using an outlet conduit 20*c* such as that described hereinabove relative to FIG. 1 for example.

Figure 4:
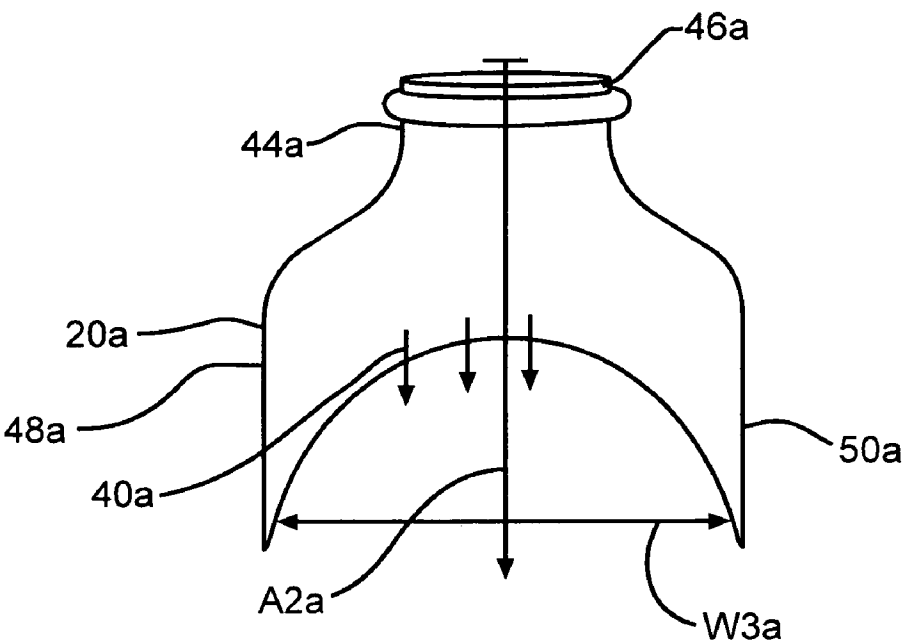
FIG. 4 is a partial diagrammatic view of a conduit of FIG. 1.

Moreover, it is expected that, in one embodiment, by using an inlet conduit 20*a* having a relatively wide opening (e.g., as indicated via dimension W3*a* in FIG. 4 compared with the dimension D4*a* shown in FIG. 5) for transmitting exhaust gas into the inlet port 32*a* of the housing 12, distribution of exhaust gas to a fluid treatment element 16 may be more effective since exhaust gas may form a relatively wide fluid path moving from the inlet conduit 20*a* and into the housing 12, as compared with an inlet conduit 20*a* having a more narrow opening for transmitting exhaust gas into the inlet port 32*a*. Thus, exhaust gas being transmitted into the housing 12 from the inlet conduit 20*a* may be more evenly distributed across the face of an exhaust treatment element 16 held within the housing 12 since the inlet conduit 20*a* (and the inlet port 32*a*) facilitates a wider fluid path entering the housing 12. Moreover, positive exhaust flow velocity effects may be achieved with such an arrangement.

Further, it is expected that, in one embodiment, by increasing the cross-sectional area of the inlet conduit 20*a* from a first cross-sectional area at a first cross-section 46*a* to a larger (for example wider) cross-sectional area at a second cross-section 48*a*, backpressure on the engine exhaust line (e.g., downstream of an engine combustion chamber) would be reduced, as compared with an inlet conduit having a relatively constant or decreasing cross-sectional area moving from the first cross-section to the second cross-section and into the inlet port of the housing. Moreover, such backpressure benefits are expected as well by using an outlet conduit 20*c* with differing first and second cross-sections 48*c*, 46*c* such as that described hereinabove relative to FIG. 1 for example.

From the foregoing it will be appreciated that, although specific embodiments have been described herein for purposes of illustration, various modifications or variations may be made without deviating from the spirit or scope of inventive features claimed herein. Other embodiments will be apparent to those skilled in the art from consideration of the specification and figures and practice of the arrangements disclosed herein. It is intended that the specification and disclosed examples be considered as exemplary only, with a true inventive scope and spirit being indicated by the following claims and their equivalents.

What is claimed is:

1. A system for treating exhaust gas from an engine, comprising:

a housing with a first longitudinal axis and having an inlet port and an outlet port, the housing defining a first generally longitudinal flow path arranged generally along or generally parallel with the first longitudinal axis of the housing and between the inlet port and the outlet port;

a fluid treatment element arranged in the first generally longitudinal flow path of the housing;

a conduit defining a second longitudinal axis and forming a second flow path generally along the second longitudinal axis, the second longitudinal axis being generally transverse to the first longitudinal flow path, the conduit being configured to communicate exhaust gas with a first port of the housing and having first and second tubular portions generally aligned with the second longitudinal axis of the conduit, the first tubular portion having a first cross-section defined in part by a first inner diameter measured in a direction generally parallel with the first longitudinal axis of the housing, the second tubular portion having a second cross-section arranged proximate the first port of the housing and defined in part by a second inner diameter measured in a direction generally parallel with the first longitudinal axis of the housing, the second inner diameter of the second cross-section being less than the first inner diameter of the first cross-section;

wherein the centerpoint of the first inner diameter of the first cross-section is offset from the centerpoint of the second inner diameter of the second cross-section by an offset amount measured in a direction generally parallel to the first longitudinal axis of the housing.

2. The system of claim 1, wherein:

the first cross-section of the first tubular portion is generally circular;

the second cross-section of the second tubular portion is generally elongated and has a width measured in a direction generally perpendicular to the second inner diameter of the second cross-section; and the width of the second cross-section is greater than the first inner diameter of the first cross-section.

3. The system of claim 1, wherein:

the conduit is an inlet conduit;

the first port is the inlet port of the housing; and the system includes:

an outlet conduit defining a third longitudinal axis and forming a third flow path generally along the third longitudinal axis, the third longitudinal axis being generally transverse to the first longitudinal flow path, the conduit being configured to communicate exhaust gas with the exhaust port of the housing and having third and fourth tubular portions generally along the third longitudinal axis of the conduit, the third tubular portion having a third cross-section defined in part by a third inner diameter measured in a direction generally parallel with the first longitudinal axis of the housing, the fourth tubular portion having a fourth cross-section arranged proximate the exhaust port of the housing and defined in part by a fourth inner diameter measured in a direction generally parallel with the first longitudinal axis of the housing, the fourth inner diameter of the fourth cross-section being less than the third inner diameter of the third cross-section;

wherein the centerpoint of the third inner diameter of the third cross-section is offset from the centerpoint of the fourth inner diameter of the fourth cross-section by an offset amount measured in a direction generally parallel to the first longitudinal axis of the housing.

4. The system of claim 3, wherein:

the third cross-section of the third tubular portion is generally circular;

the fourth cross-section of the fourth tubular portion is generally elongated and has a width measured in a direction generally perpendicular to the fourth inner diameter of the fourth cross-section; and the width of the fourth cross-section is greater than the third inner diameter of the third cross-section.

5. The system of claim 1, wherein the offset amount is equal to or greater than about 5 percent of the first inner diameter.

6. The system of claim 5, wherein the offset amount is equal to or greater than about 20 percent of the first inner diameter.

7. A system for treating exhaust gas from an engine, comprising:

a housing with a first longitudinal axis and having an inlet port and an outlet port, the housing defining a first generally longitudinal flow path arranged generally along or parallel with the first longitudinal axis of the housing and between the inlet port and the outlet port;

a fluid treatment element arranged in the first generally longitudinal flow path of the housing;

an inlet conduit defining a second longitudinal axis and forming a second flow path generally along the second longitudinal axis, the second longitudinal axis being generally transverse to the first longitudinal flow path, the inlet conduit being configured to communicate exhaust gas toward the inlet port of the housing and having first and second tubular portions generally along the second longitudinal axis of the inlet conduit, the first tubular portion having a first cross-section defined in part by a first inner diameter measured in a direction generally parallel with the first longitudinal axis of the housing, the second tubular portion having a second cross-section arranged proximate the inlet port of the housing and defined in part by a second inner diameter measured in a direction generally parallel with the first longitudinal axis of the housing, the centerpoint of the first inner diameter of the first cross-section being offset from the centerpoint of the second inner diameter of the second cross-section by a first offset amount measured in a direction generally parallel to the first longitudinal axis of the housing; and an outlet conduit defining a third longitudinal axis and forming a third flow path generally along the third longitudinal axis, the third longitudinal axis being generally transverse to the first longitudinal flow path, the outlet conduit being configured to communicate exhaust gas away from the outlet port of the housing and having third and fourth tubular portions generally along the third longitudinal axis of the outlet conduit, the third tubular portion having a third cross-section defined in part by a third inner diameter measured in a direction generally parallel with the first longitudinal axis of the housing, the fourth tubular portion having a fourth cross-section arranged proximate the outlet port of the housing and defined in part by a fourth inner diameter measured in a direction generally parallel with the first longitudinal axis of the housing, the centerpoint of the third inner diameter of the third cross-section being offset from the centerpoint of the fourth inner diameter of the fourth cross-section by a second offset amount measured in a direction generally parallel to the first longitudinal axis of the housing.

8. The system of claim 7, wherein the absolute value of the first offset amount is substantially the same as the absolute value of the second offset amount.

9. The system of claim 8, wherein the centerpoints of the first and third inner diameters are separated by a first distance measured in a direction generally parallel to the first longitudinal axis of the housing, and the centerpoints of the second and fourth inner diameters are separated by a second distance measured in a direction generally parallel to the first longitudinal axis of the housing, the second distance being greater than the first distance.

10. The system of claim 8, wherein the centerpoints of the first and third inner diameters are separated by a first distance measured in a direction generally parallel to the first longitudinal axis of the housing, and the centerpoints of the second and fourth inner diameters are separated by a second distance measured in a direction generally parallel to the first longitudinal axis of the housing, the second distance being less than the first distance.

11. The system of claim 8, wherein the centerpoints of the first and third inner diameters are separated by a first distance measured in a direction generally parallel to the first longitudinal axis of the housing, and the centerpoints of the second and fourth inner diameters are separated by a second distance measured in a direction generally parallel to the first longitudinal axis of the housing, the second distance being substantially equal to the first distance.

12. The system of claim 7, wherein the first inner diameter of the first cross-section of the first tubular portion is substantially equal to the third inner diameter of the third cross-section of the third tubular portion, and the second inner diameter of the second cross-section of the second tubular portion is substantially equal to the fourth inner diameter of the fourth cross-section of the fourth tubular portion.

13. The system of claim 7, wherein the first offset amount is equal to or greater than about 5 percent of the first inner diameter.

14. The system of claim 13, wherein the second offset amount is equal to or greater than about 5 percent of the third inner diameter.

15. The system of claim 13, wherein the first offset amount is equal to or greater than about 20 percent of the first inner diameter.

16. The system of claim 15, wherein the second offset amount is equal to or greater than about 20 percent of the third inner diameter.

17. A system for treating exhaust gas from an engine, comprising:

a housing with a first longitudinal axis and having an inlet port and an outlet port, the housing defining a first generally longitudinal flow path arranged generally along or generally parallel with the first longitudinal axis of the housing and between the inlet port and the outlet port;

a fluid treatment element arranged in the first generally longitudinal flow path of the housing;

a conduit defining a second longitudinal axis and forming a second flow path generally along the second longitudinal axis, the second longitudinal axis being generally transverse to the first longitudinal flow path, the conduit being configured to communicate exhaust gas with a first port of the housing and having first and second tubular portions generally aligned with the second longitudinal axis of the conduit, the first tubular portion having a first cross-section defined in part by a first inner diameter measured in a direction generally parallel with the first longitudinal axis of the housing, the second tubular portion having a second cross-section arranged proximate the first port of the housing and defined in part by a second inner diameter measured in a direction generally parallel with the first longitudinal axis of the housing, the second inner diameter of the second cross-section being less than the first inner diameter of the first cross-section;

wherein the centerpoint of the first inner diameter of the first cross-section is offset from the centerpoint of the second inner diameter of the second cross-section by an offset amount measured in a direction generally parallel to the first longitudinal axis of the housing; and wherein the first longitudinal axis of the housing and the second longitudinal axis of the conduit are substantially perpendicular to one another.

18. The system of claim 17, wherein the inlet port of the housing has a cross-section substantially parallel to the first longitudinal axis of the housing.

19. The system of claim 17, wherein the second cross-section of the second tubular portion is generally elongated and has a width measured in a direction generally perpendicular to the second inner diameter of the second cross-section; and the width of the second cross-section is greater than the first inner diameter of the first cross-section.

20. The system of claim 17, wherein the offset amount is equal to or greater than about 5 percent of the first inner diameter.

* * * * *